US005823809A

United States Patent [19]

Wakata

[11] Patent Number: 5,823,809

[45] Date of Patent: Oct. 20, 1998

[54] LEVER-TYPE CONNECTOR

[75] Inventor: Shigekazu Wakata, Yokkaichi, Japan

[73] Assignee: Sumitomo Wiring Systems, Ltd., Japan

[21] Appl. No.: 735,991

[22] Filed: Oct. 24, 1996

[30] Foreign Application Priority Data

Oct. 24, 1995 [JP] Japan ..... 7-300614
Nov. 17, 1995 [JP] Japan ..... 7-323915

[51] Int. Cl.[6] ..... H01R 13/62
[52] U.S. Cl. ..... 439/157
[58] Field of Search ..... 439/152–160

[56] References Cited

U.S. PATENT DOCUMENTS 5,135,408 8/1992 Suzuki ..... 439/157
5,344,194 9/1994 Hatagishi et al. ..... 439/157
5,401,179 3/1995 Shinchi et al. ..... 439/157
5,474,461 12/1995 Saito et al. ..... 439/157

FOREIGN PATENT DOCUMENTS 4-87169 3/1992 Japan .
6-243929 9/1994 Japan .

*Primary Examiner*—Neil Abrams
*Assistant Examiner*—Brian J. Biggi
*Attorney, Agent, or Firm*—Banner & Witcoff, Ltd.

[57] ABSTRACT

A lever-type electrical connector 10,20 has a lever 30 pivotable from open to closed conditions to draw the connector parts together. A resilient latch 33,14 holds the lever in the closed condition. When the lever 30 is unlatched by depressing an abutment **14*b* it is given an initial upward movement by virtue of a ramped abutment 14*d*1, 14*b*1, 34 or by a resilient spring formed e.g. by a waterproof ring seal 15**. This initial movement permits the lever to be grasped for further movement. A separate wire spring is avoided.

14 Claims, 6 Drawing Sheets

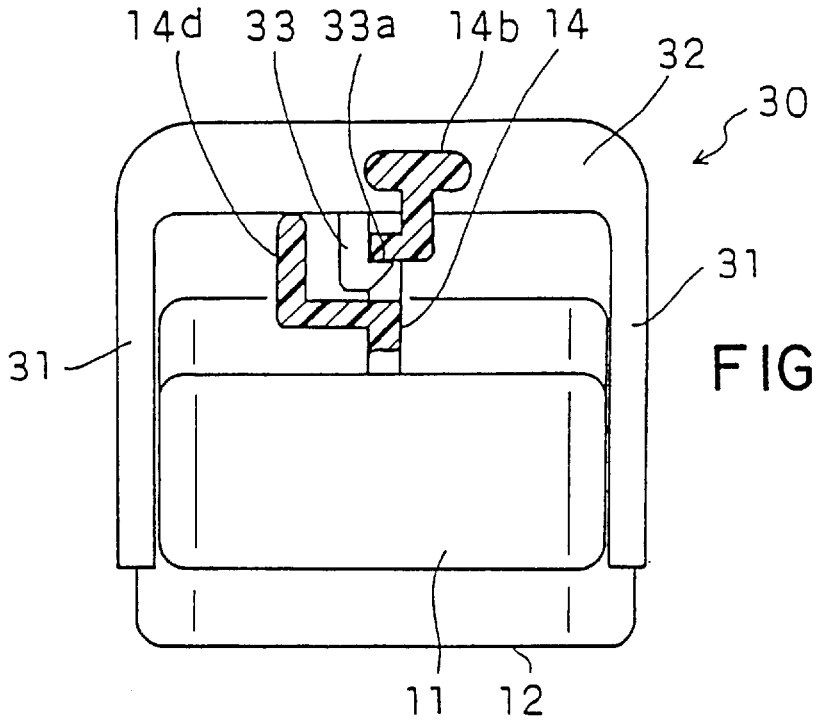
FIG. 3
FIG. 4
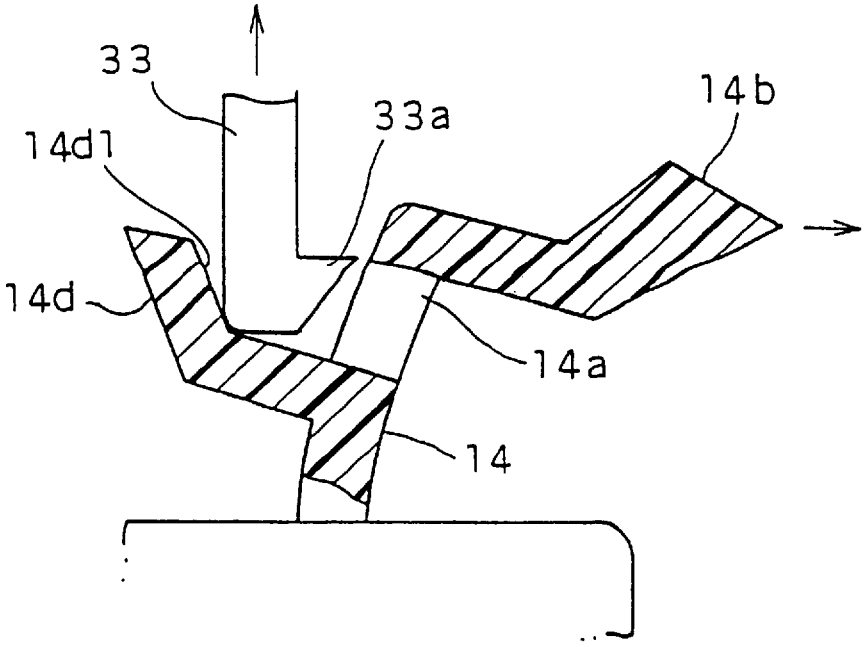

LEVER-TYPE CONNECTOR

TECHNICAL FIELD

The present invention relates to a lever-type connector, and particularly to a lever-type electrical connector.

BACKGROUND TO THE INVENTION

FIG. 13 and FIG. 14 of this specification show a conventional lever-type electrical connector in which a male connector 1 has a hood 2. A C-shaped pivoting lever 3 straddles the hood 2 from above and has arms 3*a* and 3*b* which engage the hood 2. Axial holes 3*a*1 are formed on the pivot axis of the lever 3. Axial pins 2*a* formed on the external face of the side wall of the hood 2 pass through the axial holes 3*a*1, thereby making the lever 3 pivotable. The internal side faces of the arms 3*a* have spiral-shaped cam grooves 3*a*2. The external-most portions of these cam grooves 3*a*2 form guiding apertures 3*a*3 which open in the direction of the open side of the hood 2.

A female connector 4 is insertable into the hood 2. In the side walls of the female connector 4, cam pins 4*a* project outwards from slits 2*b* formed from the open side of the hood 2. After inserting these cam pins 4*a* into the slits 2*b*, the pins 4*a* engage the grooves 3*a*2 of the lever 3, and when the lever 3 is pivoted, the male and female connector are drawn together.

One of the axial pins 2*a* has a helical spring 5 wound around it. One end of the spring 5 is fixed to the lever 3 and the other end is fixed to the hood 2 so as to bias the lever in the open direction.

A bridge member 3*b* that connect the arms 3*a* has a latch member 3*c* that projects in the direction of the male connector 1 when the lever 3 is in the closed position. The latch member 3*c* has a projection 3*c*1 formed at an anterior end which protrudes in a posterior direction. Furthermore, the male connector 1 has a locking member 6 that has a latch hole 6*a* provided therein. The locking member 6 protrudes in the direction of the fitting member 3*c*, and the latch hole 6*a* allows the projection 3*c*1 to be engaged therein. The locking member 6 has a pressing-down member 6*b*. When the pressing-down member 6*b* is pressed down, the locking member 6 bends and, as shown in FIG. 9, the projection 3*c*1 separates from the latch hole 6*a*. When the fitting is released the lever 3 pivots up slightly due to the helical spring and reaches a state in which it can be engaged by hand for movement to the open condition.

In this conventional lever-type connector, the helical spring 5 causes the lever 3 to rise slightly after the release of the latch. Since a separate part must be attached, the production process becomes problematic, and production cost also rises.

The present invention has been developed after taking the above problem into account, and aims at presenting a low cost lever-type connector wherein the lever is made to rise upwards after the release of the fitting, but without the helical spring 5.

SUMMARY OF THE INVENTION

According to the invention there is provided a connector having a body, an arm pivotable on said body from an open to a latched position, the arm being releasably retainable in a latched position, and disengagement means to urge said arm from the latched position characterised in that said disengagement means is arranged to urge said arm from the latched position to a delatched position intermediate said latched and open positions when said arm is delatched.

Such a connector has an arm which can be urged to a delatched condition where it can be manually moved to the open position. Normally the resistance to movement of the connector cables means that greater force is required to fully separate the two parts of a connector. Accordingly there is no strain on the disengagement means whilst the arm is in the fully open position.

The disengagement means may be a rigid abutment having for example a ramped face to urge the arm to a delatched position, or it may be an elastomeric material such as a rubber component.

The rigid abutment or rubber component may be an integral part of a latching member, and in a preferred embodiment the latching member has a resilient foot to permit movement from a latched to an unlatched condition. In this arrangement resilient movement of the latching member releases the latch and brings the disengagement means into contact with the arm, thereby to move the arm to the delatched position; removal of the delatching force permits the latching member to return to the rest position whilst leaving the arm in the delatched position for subsequent manual movement.

This arrangement has the particular advantage that the disengagement means is not under load whilst the arm is in the latched position.

The arm is preferably in the form of a stirrup and has a depending latch projection for engagement by the latching member. The disengagement means preferably acts directly on the latch projection.

The rigid abutment may be made as part of a one piece connector body, for example a plastics moulding, thus eliminating entirely the need for a spring and the consequent assembly step.

In the case of the elastomeric material, a rubber block on the arm or for engagement by the arm is suitable. In a preferred embodiment a moisture seal of the connector also constitutes the disengagement means, thus eliminating the separate spring and consequent assembly step. Preferably the usual retaining tab of such a moisture seal provides the disengagement means.

A rubber block can provide the necessary delatching movement for the arm but is relatively inexpensive compared with a wire spring, and is moreover easy to assemble to a connector body or to a latching member using e.g. adhesive or a projecting tang.

The latching member may be provided on the body of the connector or on the body of another component with which the connector is fitted in use.

This invention is particularly useful for lever-type connectors in which the arm is flush with the connector body in the latched condition and thus difficult to grasp for delatching.

BRIEF DESCRIPTION OF DRAWINGS

Other features of the invention will be apparent from the following description of several preferred embodiments shown by way of example only in the accompanying drawings in which:

FIG. 3 is a partial side view of a third variant of the lever-type connector.

FIG. 4 is an enlarged side view of the main parts of the lever-type connector relating to the first variant.

DESCRIPTION OF PREFERRED EMBODIMENTS

Figure 1:
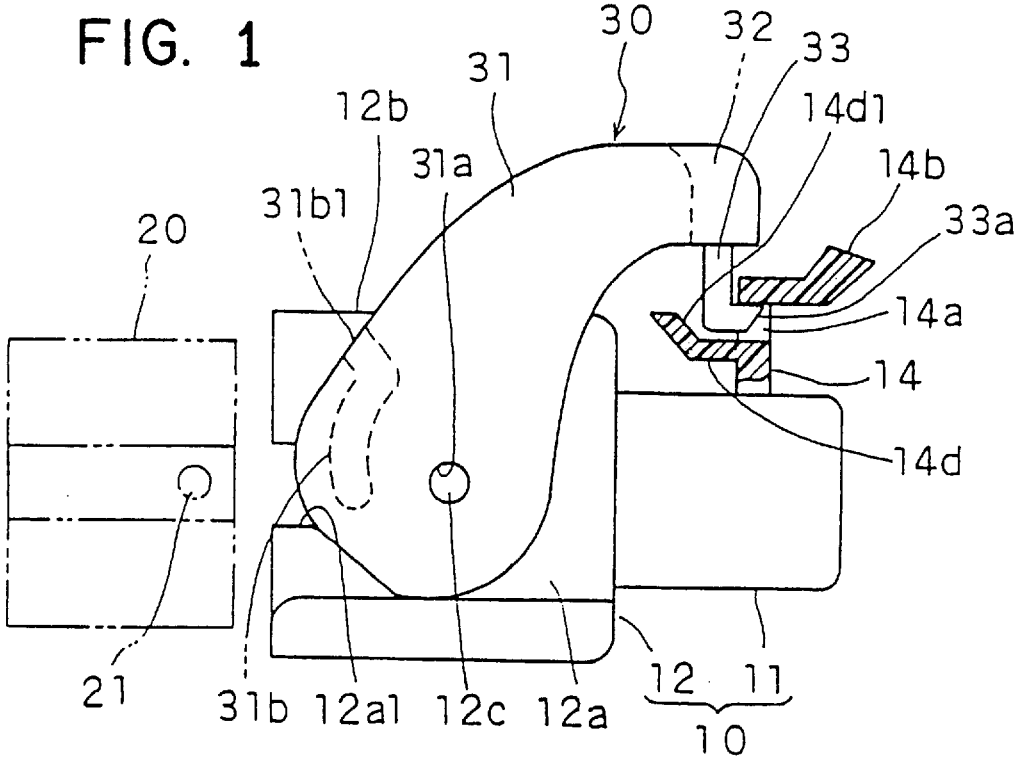
FIG. 1 is a side view of a first variant of a lever-type connector of the present invention.

FIG. 1 shows a male connector 10 that serves as a housing and comprises a terminal insertion member 11 and a hood 12. The terminal insertion member 11 is rectangularly box shaped and has a plurality of tubular terminal insertion chambers (not shown) which in use support conventional male terminal fittings. The hood 12 protrudes tubularly from the periphery of the open faces of the terminal insertion chambers. A female connector 20 is insertable into the hood 12. The hood 12 has retraction slits 12*a*1 formed towards the open sides of side walls 12*a* thereof. These retraction slits 12*a*1 correspond to retraction pins 21 projecting from the side wall faces of the female connector 20.

A pivoting lever 30 is schematically C-shaped so as to straddle the hood 12 from above. The lever 30 comprises arms 31 that face the outer faces of the side walls 12*a* of the hood 12, and a base 32 that faces the upper face of a ceiling wall 12*b* of the hood 12. The outer faces of the side walls 12*a* have axial pins 12*c* that project outwards. The arms 31 have axial holes 31*a* that receive the axial pins 12*c*. Furthermore, it is arranged so that the arms 31 may be flexibly opened and made to straddle the hood 12, the axial pins 12*c* being inserted into the axial holes 31*a*, thereby allowing the lever 30 to be pivotably fitted. Spiral cam grooves 31*b* are formed on the inner side faces of the arm members 31. The outer extreme portions of the cam grooves 31*b* open towards the side faces of the arms 31 and form guiding apertures 31*b*1. When the lever 30 is rotated maximally in the counter-clockwise direction with respect to FIG. 1 (this is the open condition), the guiding holes 31*b*1 coincide with the open end of the retraction slits 12*a*1. This makes it possible for the retraction cam pins 21 of the female connector 20 to enter into the cam grooves 31*b*. As the lever 30 is pivoted in the clock-wise direction, the spiral cam grooves 31*b* cause the retraction cam pins 21 to be drawn towards the direction of the axial pins 12*c*. As a result, the female connector 20 is drawn into the hood member 12. The position of the lever 30 whereby the female connector 20 is in a retracted state deep into the hood member 12 is known as the closed condition.

The upper face of the terminal insertion member 11 has a locking member 14 formed so as to project upwards, and the lever 30 also has a latch member 33 formed so as to project towards the locking member 14. The latch member 33 is formed so as to approach the anterior end of the locking member 14 when the closed condition is reached. A wedge shaped fitting projection 33*a* is formed on the anterior end face of the latch member 33. This fitting projection 33*a* faces towards the locking member 14. In the closed condition, the projection 33*a* engages a fitting hole 14*a* formed in the locking member 14. The upper end of the locking member 14 has an operating member 14*b* that is offset towards the rear so as to avoid collision with the base 32. When the operating member 14*b* is pressed downwards, the locking member 14 itself inclines in a rearwards direction since the operating member 14*b* is offset towards the rear. This rearward inclination allows the locking member 14 to be released.

The locking member 14 has a projection 14*d* formed so as to extend forwardly from somewhat below the fitting hole 14*a* and so as to curve around and upwards from the lower part of the latch member 33. This projection 14*d* has an inclined face 14*d*1 that faces the front lower end of the latch member 33. When the locking member 14 inclines posteriorly, this projection 14*d* moves approximately horizontally in a rearwards direction and causes the inclined face 14*d*1 to collide with the lower end of the latch member 33 (FIG. 4). As a result, the latch member 33 is pressed upwards along the inclined face 14*d*1, which in turn causes the lever 30 to be pushed backwards slightly from the closed condition in the direction of the open condition. In other words, the inclined face 14*d*1 of the projection 14*d* constitutes a movable abutment.

Figure 2:
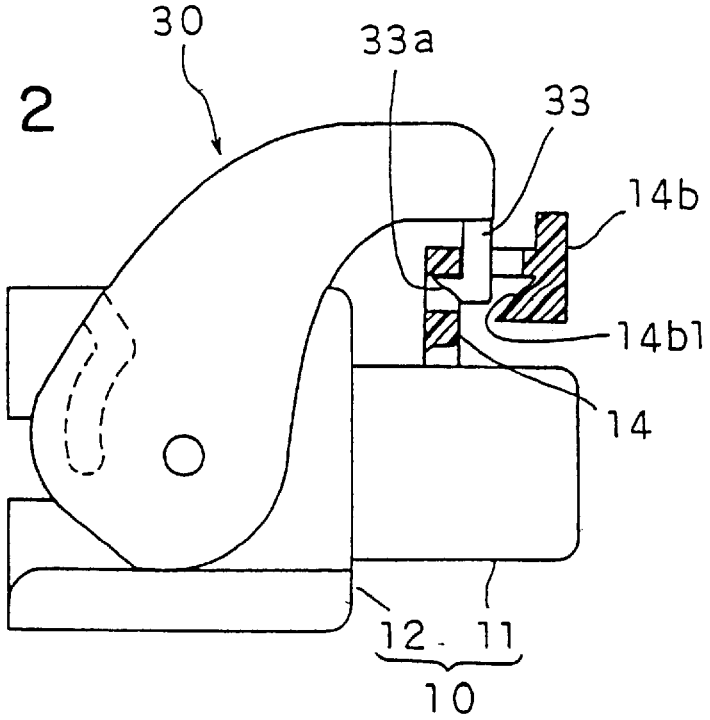
FIG. 2 is a partial side view of a second variant of the lever-type connector.
Figure 5:
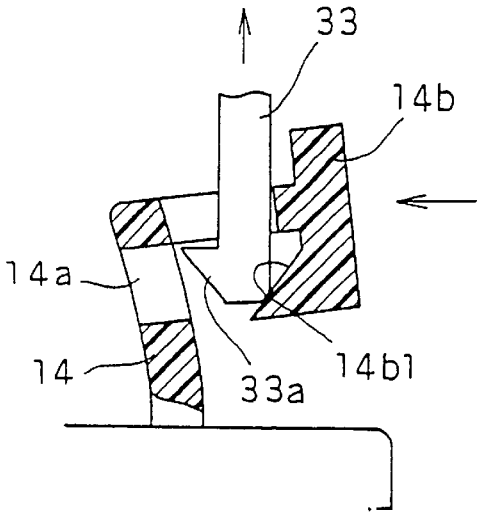
FIG. 5 is an enlarged side view of the main parts of the lever-type connector relating to the second variant.

In this first variant, although the locking member 14 is arranged to incline in a rearwards direction, all that is necessary is that it be inclinable. Consequently, as shown in FIGS. 2 and 5, in the case where the latch member 33 is to the rear of the locking member 14 and the fitting projection 33*a* protrudes in a forwards direction, the locking member 14 inclines in a forwards direction, and the latch member 33 is released by pressing the operating member 14*b* from a rear towards the front. Moreover, as shown in FIG. 3, the inclining movement is not limited to a front/rear movement; a left-right movement is possible as well so that downwards and rightwards (as viewed) movement of the locking member 14*b* causes an upward engagement of the projection 14*d* on the latch member 33. Furthermore, the lever 30 and the locking member 14 need only fit together; there are no limitations regarding the basic concave-convex fitting shapes of the lever 30 and the locking member 14.

Figure 6:
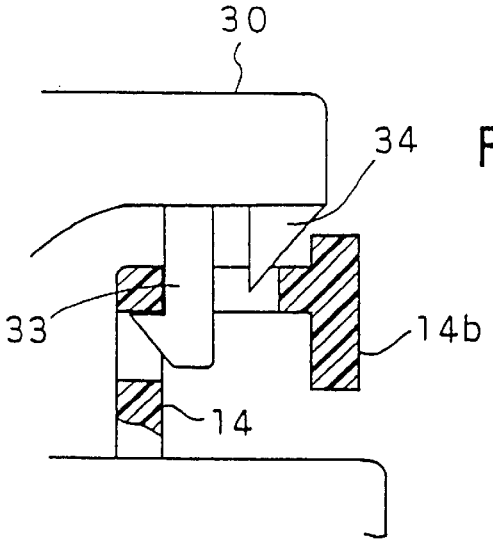
FIG. 6 is an enlarged side view of the main parts of the lever-type connector relating to a fourth variant.
Figure 7:
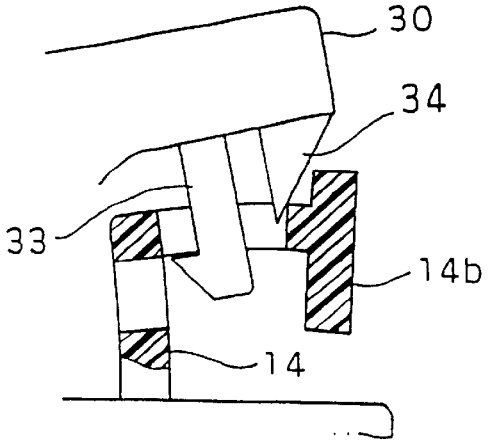
FIG. 7 is an enlarged side view of the main parts of the fourth variant in another position.
Figure 8:
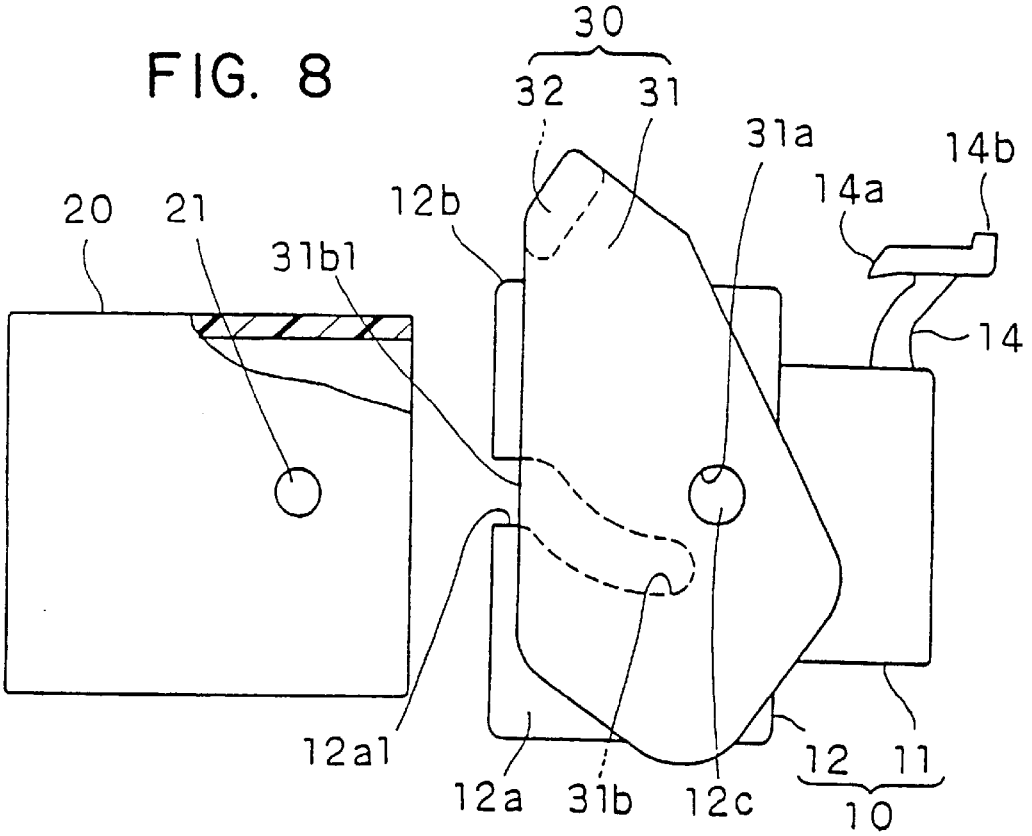
FIG. 8 is a side elevation of a fifth variant of the invention in a disassembled state.

In the present embodiment, although a configuration is assumed whereby the locking member 14 inclines in a posterior direction, as shown in FIG. 2, in the case where the locking member 14 inclines in an anterior direction, it may equally be arranged that an inclined face 14*b*1 be formed on the lower anterior face of the operating member 14*b*, and that during the pressing down operation the inclined face 14*b*1 collide with the lower end of a latch member 33 when it is pushed, thereby pushing the latch member 33 back. That is, all that is required is that there be a direct or indirect way of causing the lever 30 to be pushed back towards the open condition by means of the inclining operation of the locking member. Consequently, it may equally be arranged that an inclined face be formed on the lever 30. In the configuration shown in FIG. 6 and FIG. 7, an inclined face 34 is formed on the lever 30 so as to face the operating member 14*b*. This is in contrast to the pressing-down type configuration shown in FIG. 2. As a result, if the operating member 14*b* is pushed forwards (as viewed), it collides with the inclined face 34 causing it to be pushed upwards. The shape etc. of the inclined face 34 formed towards the rotating lever 30 can be varied as necessary to give desired release characteristics. These inclined faces may be advantageously located in positions where it is easy to change the shapes thereof as necessary, so as to correspond with the shapes of peripheral members, and so on.

Next, the operation of the first variant is explained.

The lever 30 is pivoted up to the initial position and the female connector 20 is inserted into the hood member 12. The retraction cam pins 21 of the female connector 20 enter the cam grooves 31 via the guiding holes 31*b*1 of the arm members 31. Then, the rotating lever 30 is rotated in the clock-wise direction from the initial position to the final position. Accordingly, the female connector 20 is pulled deep into the hood member 20.

The latch member 33 is pushed so as to brush against the anterior face of the locking member 14, and the fitting projection 33*a* enters and fits with the fitting hole 14*a*. Accordingly, the lever is firmly latched.

When it becomes necessary to separate the male connector 10 and the female connector 20, the operating member 14*b* located at the upper end of the locking member 14 is pushed downwards. When this is done, the locking member 14 inclines in a posterior direction due to the lowering of the operating member 14*b* that is in an offset position. As a result, the latch member 33 is released. Moreover, since the projecting member 14*d* moves in a posterior direction, the inclined face 14*d*1 abuts with the lower end of the latch member 33, thereby pushing it upwards a little. Since the lever 30 is now in a floating state, having been pushed back slightly towards the open condition, the lever 30 can be grasped and easily moved to the fully open condition despite resistance of associated terminals cables and the like. Positive lifting of the latch member overcomes another prior problem that the internal spring may stick or jam.

In the present invention, although a terminal insertion member 11 and the hood 12 are provided, there is no particular restriction in this regard. Moreover, although application to the male connector 10 is described above, the description is equally applicable if the side which houses the female terminal fittings is considered instead. Although the lever-type connector was originally developed to prevent deterioration in operability that accompanies the increase in fitting force due to multiple terminals, the lever-type connector is not necessarily limited to multiple terminal use and is also applicable for other purposes such as preventing disconnection, by means of a cam structure.

In the present invention, it is not necessary for the lever 30 to straddle the hood 12 as long as it is pivotably supported and can retract the corresponding connector. Moreover, it is not necessary to have the cam grooves formed on the side of the lever 30; the locations of the cam pins and the cam grooves can be reversed. Furthermore, for convenience and depending on the pivoting operation, a retractable concave-convex shape can be provided apart from the fitting configuration comprising the cam pins and the cam grooves.

Another embodiment is illustrated in FIGS. 8–10 and 12. This fifth variant is functionally similar to the first variant but includes a water seal which imparts a resilient return force to the latch member 33. Similar parts carry the same reference numbers as used to describe the first to fourth variants.

In the fifth variant the female connector 10 comprises a terminal insertion member 11 and a hood 12 which protrudes. A male connector 20 is insertable into the hood 12. The hood 12 has retraction slits 12*a*1 which correspond to retraction pins 21 as previously described.

A lever 30 straddles the hood 12 from above and has arms 31 pivoted on the hood 12 as previously described. Spiral cam grooves 31*b* are formed on the inner side faces of the arm members 31 for engagement with the cam pins 21, so as to pull the connectors together as previously described.

Figure 12:
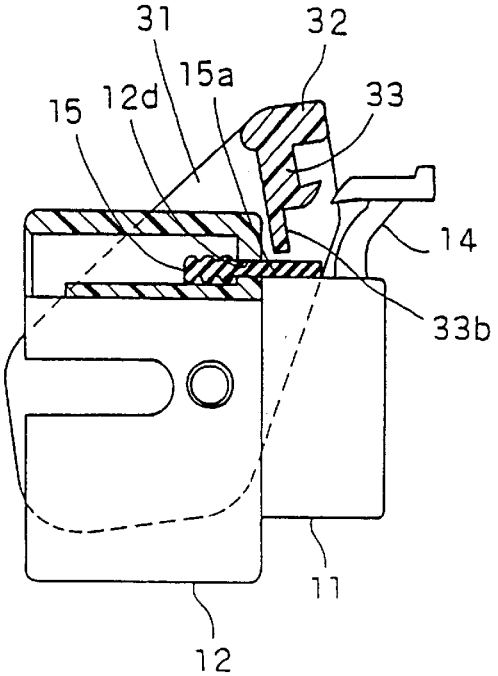
FIG. 12 is a partially cut away view of the fifth variant in an unlatched condition.
Figure 13:
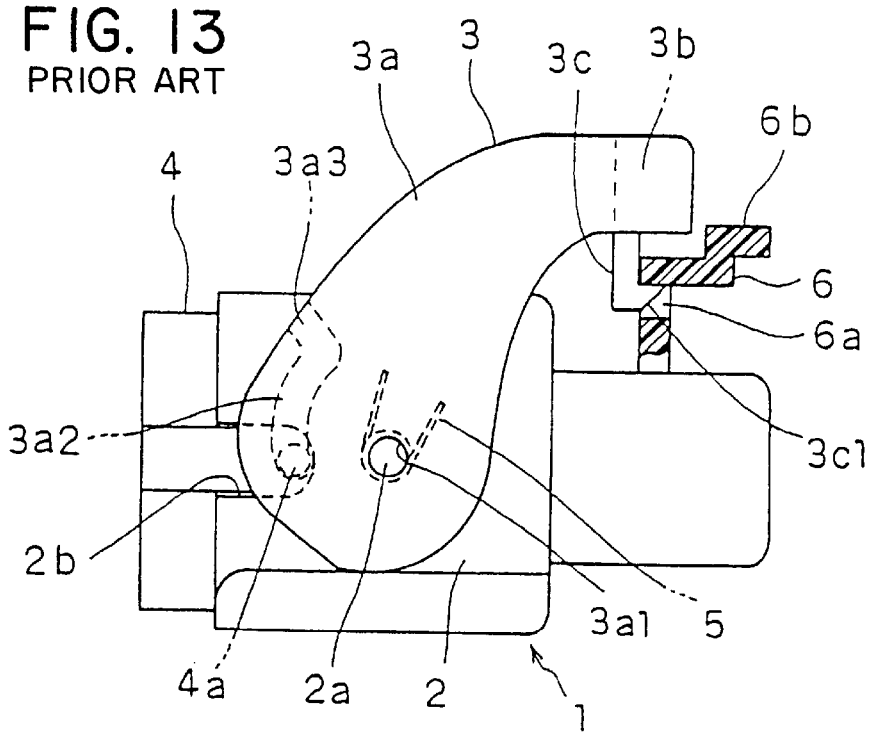
FIG. 13 PRIOR ART
FIG. 13 is a side view of the conventional lever-type connector in a latched condition.
Figure 14:
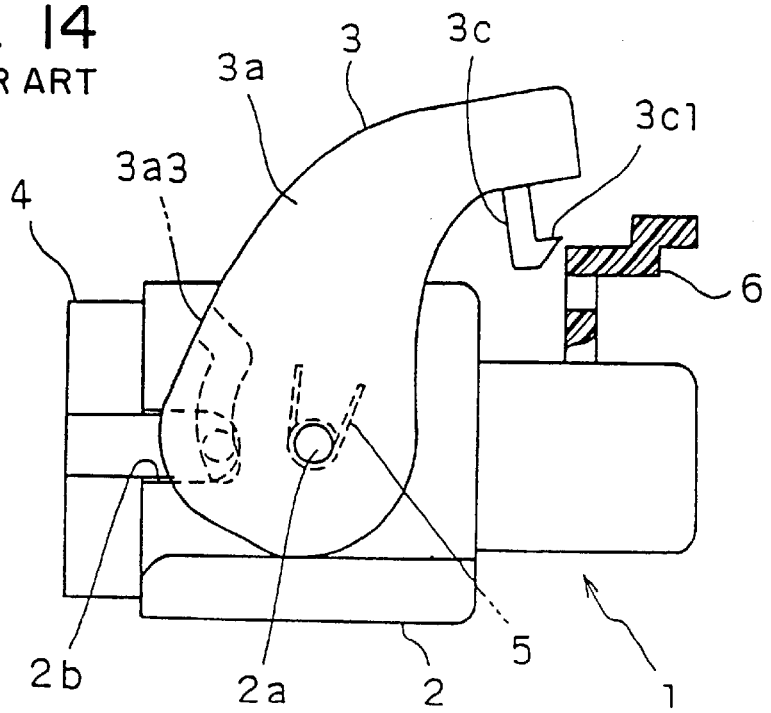
FIG. 14 PRIOR ART
FIG. 14 is a side view of the conventional lever-type connector in an unlatched condition.

The posterior end of the upper face of the terminal insertion member 11 has a locking member 14 formed so as to project upwards, and the lever 30 also has a latch member 33 formed so as to project towards the locking member 14. The latch member 33 is formed so as to approach the anterior end of the locking member 14 when the final position is reached. A wedge shaped fitting projection 33*a* is formed on the anterior end face of the latch member 33. This fitting projection 33*a* faces towards the locking member 14. In the final position (FIG. 9), the fitting projection 33*a* engages a fitting hole or recess 14*a*. The upper end of the locking member 14 has an operating member 14*b* that is offset towards a posterior direction so as to avoid collision with the base member 32 of the lever 30. When the operating member 14*b* is pressed downwards, the entire locking member 14 inclines in a posterior direction to release the fitting projection 33*a* (FIG. 12).

Figure 9:
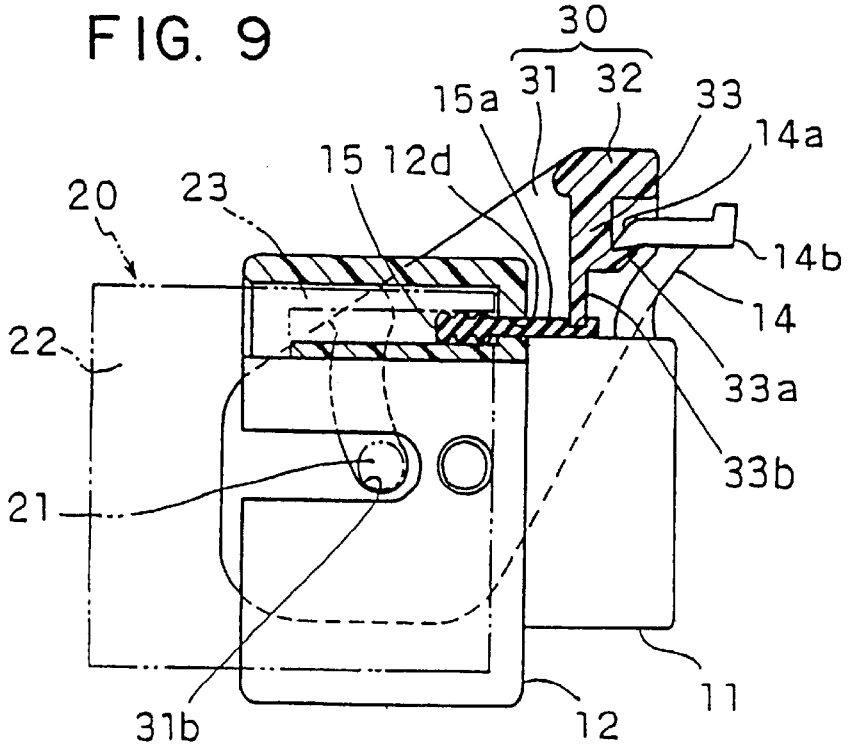
FIG. 9 is a partial side view of the fifth variant in the latched condition.

As shown in FIG. 9, a ring-shaped rubber seal 15 is attached to the exterior peripheral face of terminal insertion member 11. The rubber seal 15 forms a water-proof surface by being placed between the exterior peripheral face of the terminal insertion member 11 and the internal peripheral face of the hood 23 so as to seal against the male connector 20. The rubber seal 15 has an attachment member 15*a* that extends in a posterior direction up to the centre of the upper face of the terminal insertion member 11. The hood member 12 has a through hole 12*d* that allows the protrusion of the attachment member 15*a*. When the attachment member 15*a* is forced into the through hole 12*d*, the edge of the open end of the through hole 12*d* prevents the rubber seal 15 from being removed easily, thereby fixing the rubber seal 15 in place. This through hole 12*d* is formed towards the anterior side of the locking member 14, and the attachment member 15*a* extends up to the locking member 14.

The convex member 33 of the rotating lever 30 has an abutment member 33*b* that protrudes further in a downward direction from the fitting projection 33*a*. As shown in FIG. 9, when the lever 30 is rotated to the final position, the extreme end of the abutment member 33*b* collides with the upper face of the attachment member 15*a* and is pressed against the upper face of the terminal insertion member 11. That is, the attachment member 15*a*, the abutment member 33*b* and the upper face of the terminal insertion member 11 constitute an elastic mechanism having a resilient return force.

Figure 10:
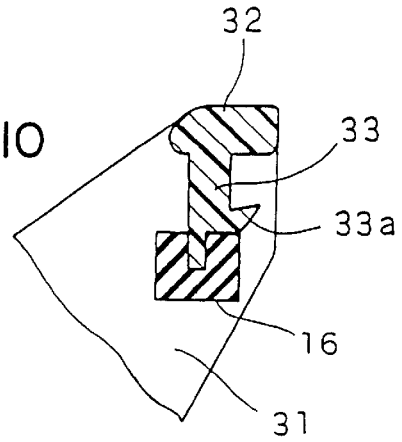
FIG. 10 is an enlarged cut away view of part of the fifth variant.
Figure 11:
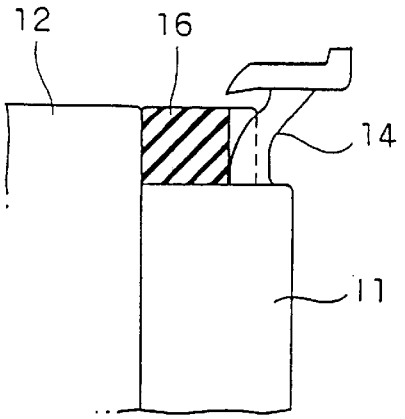
FIG. 11 is an enlarged cut away view of part of a sixth variant.

Although an elastic mechanism is constituted by the attachment member 15*a* which is a rubber member, the attachment member 15*a* being a part of the rubber seal 15, it is not necessary to use the rubber seal 15: a different rubber member may equally be attached. In such a case, as shown in FIG. 10, a rubber member 16 may be attached to the latch member 33 of the lever 30; or, as shown in FIG. 11, a rubber member 16 may equally be attached to the connector 10. Of course, the fixing method in this case can be varied according to convenience. Moreover, the place of attachment may equally be changed according to convenience as long as the resilient member is clamped between the lever 30 and the connector 10, and as long as the location is such that the lever 30 is pushed back towards the initial position due to an opposing force. For example, it may be located between the base member 32 and the terminal insertion member 11, or between the arm member 31 and the terminal insertion member 11, and so on.

However, instead of using these rubber members that are separately provided, it is preferable to use a portion of the rubber seal 15 since the complexity can be reduced. Furthermore, although the separate rubber member may require an additional assembly step, it is less complex and less troublesome than a separate spring.

Operation of this embodiment is similar to the earlier variants described. The resilient force of the seal or other rubber spring provides an initial upward force that moves the lever 30 to a position where it may be grasped for movement to the open condition.

I claim:

1. An electrical connector comprising a body, an arm pivotally attached to said body for movement between an open position and a latched position, said body having a locking member and said arm having a latch member which are interengageable to releasably retain said arm in said latched position, and a disengagement structure including an inclined face on one of said arm or said body and an operating face on the other of said arm or said body, said operating face contacting and sliding along said inclined face to move said arm from said latched position to an unlatched position intermediate said open position and said latched position when said locking member and said latch member are released.

2. An electrical connector according to claim 1 wherein said operating face is provided on said latch member and said inclined face is provided on said locking member.

3. An electrical connector according to claim 1 wherein said operating face is provided on said locking member and said inclined face is provided on said latch member.

4. An electrical connector according to claim 1 wherein said locking member is movable in a transverse direction to release the latch member and move the arm to said unlatched position.

5. An electrical connector according to claim 4 wherein said movement of said locking member is in a direction away from said arm.

6. An electrical connector according to claim 4 wherein said movement of said locking member is in a direction toward said arm.

7. An electrical connector comprising a body, an arm pivotally attached to said body for movement between an open position and a latched position, said body having a locking member and said arm having a latch member which are interengageable to releasably retain said arm in said latched position, and a disengagement structure including a resilient rubber member positioned between said body and said arm, said rubber member moving said arm from said latched position to an unlatched position intermediate said open position and said latched position when said locking member and said latch member are released.

8. An electrical connector according to claim 7 wherein the resilient rubber member is attached to the body.

9. An electrical connector according to claim 8 wherein the resilient rubber member is attached to the latch member.

10. An electrical connector according to claim 9 wherein the latch member is on said arm.

11. An electrical connector according to claim 10 wherein the latch member includes a protrusion and said resilient rubber member is retained on the protrusion.

12. An electrical connector according to claim 7 wherein the resilient rubber member is a moisture seal provided on said body.

13. An electrical connector according to claim 12 wherein said latch member includes an abutment member which engages said resilient rubber member when the arm is in the latched position.

14. An electrical connector according to claim 7 wherein said latch member includes an abutment member which engages said resilient rubber member when the arm is in the latched position.

* * * * *